US011517125B2

(12) United States Patent
Berglund et al.

(10) Patent No.: US 11,517,125 B2
(45) Date of Patent: Dec. 6, 2022

(54) EXPANDABLE MERCHANDISING SYSTEM

(71) Applicant: Process Retail Group, Inc., New Berlin, WI (US)

(72) Inventors: Terrence G. Berglund, Hales Corners, WI (US); James P. Ihrcke, West Allis, WI (US); Christopher Harrell, Wauwatosa, WI (US)

(73) Assignee: Process Retail Group, Inc., New Berlin, WI (US)

( * ) Notice: Subject to any disclaimer, the term of this patent is extended or adjusted under 35 U.S.C. 154(b) by 0 days.

(21) Appl. No.: 17/188,191

(22) Filed: Mar. 1, 2021

(65) Prior Publication Data

US 2021/0267386 A1 Sep. 2, 2021

Related U.S. Application Data

(60) Provisional application No. 62/982,435, filed on Feb. 27, 2020.

(51) Int. Cl.

| | |
|---|---|
| ***A47F 1/12*** | (2006.01) |
| ***A47F 5/00*** | (2006.01) |
| ***A47B 45/00*** | (2006.01) |
| ***A47F 5/10*** | (2006.01) |

(52) U.S. Cl.

CPC ..... *A47F 1/125* (2013.01); *A47B 45/00* (2013.01); *A47F 5/005* (2013.01); *A47F 5/10* (2013.01)

(58) Field of Classification Search

CPC ..... A47F 1/125; A47F 1/126; A47F 5/0081; A47F 5/0018; A47F 5/10; A47F 7/28; A47F 5/005; A47B 43/00; A47B 45/00

USPC ..... 211/59.2, 59.3, 184, 175, 74

See application file for complete search history.

(56) References Cited

U.S. PATENT DOCUMENTS

| | | | | | |
|---|---|---|---|---|---|
| 4,364,481 | A * | 12/1982 | Ricci | A47F 5/005 | 206/558 |
| 5,012,936 | A * | 5/1991 | Crum | A47F 1/126 | 206/556 |
| 5,366,099 | A * | 11/1994 | Schmid | A47F 1/126 | 211/175 |
| 5,390,802 | A * | 2/1995 | Pappagallo | A47B 45/00 | 211/187 |
| 5,458,248 | A * | 10/1995 | Alain | A47B 45/00 | 211/153 |
| 5,855,283 | A * | 1/1999 | Johnson | A47F 1/126 | 211/59.3 |
| 6,357,606 | B1 * | 3/2002 | Henry | A47F 1/126 | 211/184 |
| 6,886,699 | B2 * | 5/2005 | Johnson | A47F 1/126 | 108/61 |

(Continued)

*Primary Examiner* — Jennifer E. Novosad

(74) *Attorney, Agent, or Firm* — Christopher M. Scherer; DeWitt LLP

(57) ABSTRACT

This merchandising tray system is capable of adjustment for width and depth to accommodate any size of shelving unit. Within the system, a rear tray base is slidably connected to a fore tray base, allowing for adjustment of the depth of the system on the shelf. A merchandise pusher is continuously slidable within a fore pusher track in the fore tray base and a rear pusher track in the rear tray base. Right and left fore sidewalls are removably mounted to the fore tray base, allowing for lateral expansion of the system. Rear sidewalls are slidably extendable from the fore sidewalls, allowing for further alteration of the depth of the system.

18 Claims, 12 Drawing Sheets

(56) References Cited

U.S. PATENT DOCUMENTS 7,458,473 B1 * 12/2008 Mason ..... A47F 1/126 211/175
7,703,614 B2 * 4/2010 Schneider ..... A47F 3/14 211/59.3
7,918,353 B1 * 4/2011 Luberto ..... A47F 1/126 211/59.3
8,066,128 B2 * 11/2011 Crawbuck ..... A47F 1/125 211/59.3
8,556,092 B2 * 10/2013 Valiulis ..... A47F 5/005 211/184
8,646,650 B2 * 2/2014 Lockwood ..... G07G 3/003 221/151
8,851,303 B2 * 10/2014 Crawbuck ..... A47F 1/12 211/59.3
9,101,230 B2 * 8/2015 Sosso ..... A47F 5/0018
9,138,076 B2 * 9/2015 Hardy ..... A47F 5/005
9,408,478 B2 * 8/2016 Vogler ..... A47F 1/126
9,445,675 B1 * 9/2016 DeSena ..... A47F 5/005
9,629,479 B2 * 4/2017 Sosso ..... A47F 5/0823
9,629,480 B2 * 4/2017 Ewing ..... A47F 1/128
9,642,475 B2 * 5/2017 Vogler ..... A47F 1/12
9,986,852 B2 * 6/2018 Chenoweth ..... F21V 21/088
10,034,557 B1 * 7/2018 Nagel ..... A47F 1/126
10,178,909 B2 * 1/2019 Hardy ..... A47F 7/28
10,251,494 B1 * 4/2019 Nagel ..... A47F 5/005
10,334,967 B2 * 7/2019 Mercier ..... A47F 5/0087
10,555,623 B2 * 2/2020 Kologe ..... A47F 7/0071
10,912,398 B2 * 2/2021 Wills ..... A47F 5/005
10,959,543 B2 * 3/2021 Wills ..... A47F 1/125
11,064,817 B2 * 7/2021 Turner ..... A47F 1/125
2003/0085187 A1 * 5/2003 Johnson ..... A47F 1/126 211/59.3
2003/0217980 A1 * 11/2003 Johnson ..... A47F 1/126 211/59.3
2004/0245197 A1 * 12/2004 McElvaney ..... A47F 1/126 211/184
2013/0200026 A1 * 8/2013 Bryson ..... A47F 1/126 211/126.14
2020/0093282 A1 * 3/2020 Bruegmann ..... A47F 1/126
2021/0161310 A1 * 6/2021 Berglund ..... A47F 1/126
2021/0267386 A1 * 9/2021 Berglund ..... A47B 57/588

* cited by examiner

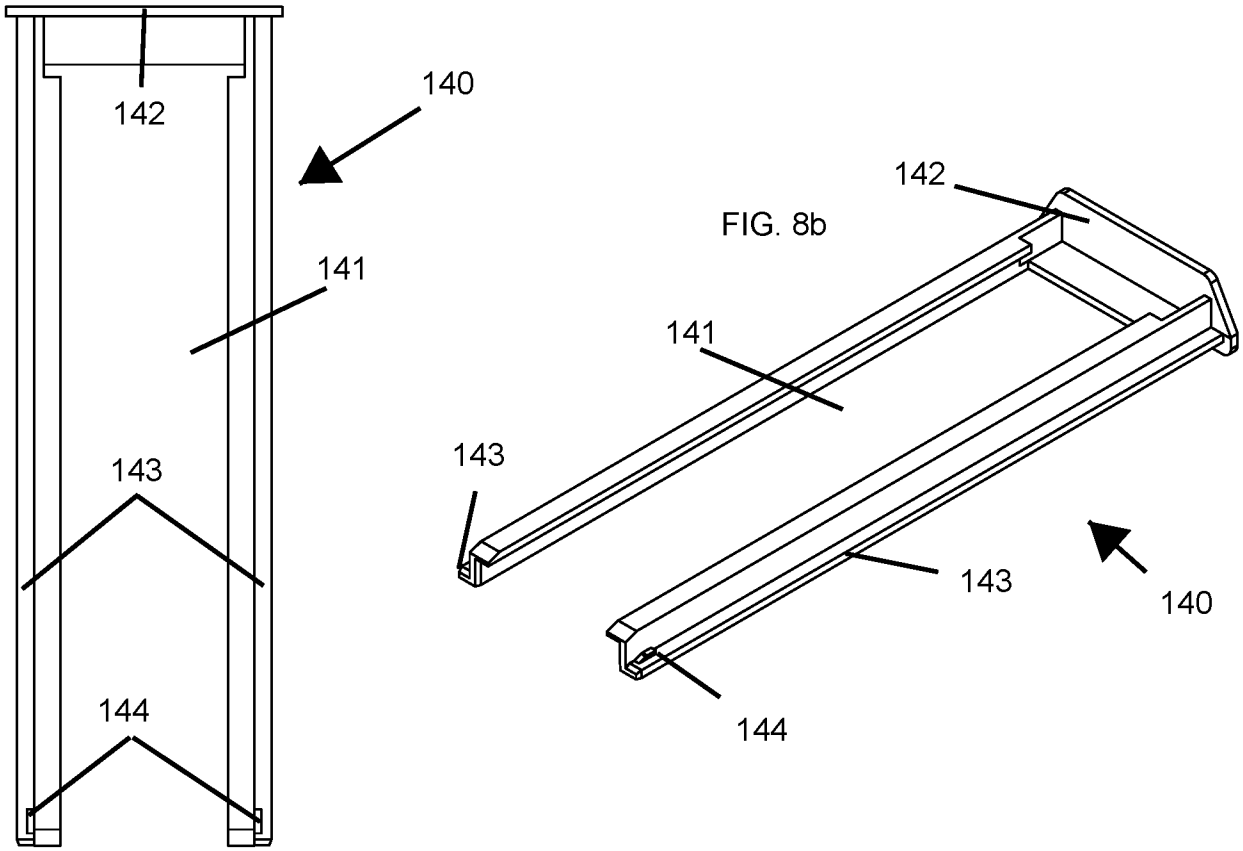
FIG. 8a
FIG. 8b
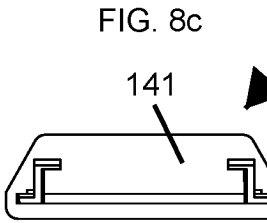
FIG. 8c
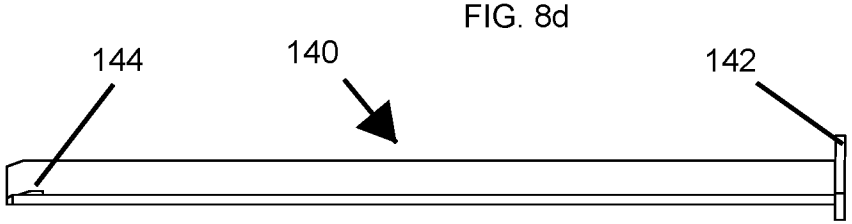
FIG. 8d

EXPANDABLE MERCHANDISING SYSTEM

CROSS-REFERENCE TO RELATED APPLICATIONS

This application claims the benefit of prior-filed, U.S. Provisional Patent Application No. 62/982,435, filed on Feb. 27, 2020, the contents of which are incorporated herein by reference in their entirety.

BACKGROUND OF THE INVENTION

1. Field of the Invention

The present invention relates to a store display, more specifically an expandable shelf tray for holding merchandise.

2. Background

Brands and retailers use merchandising systems to improve product presentation, manage space, and reduce the labor effort needed to stock and organize the product in the store. In recent years, brands and retailers have greatly reduced or eliminated field sales personnel, third party staff, and retail staff. In order to counterbalance this reduction in personnel, brands and retailers have adopted more adaptable merchandising systems to overcome the diminished number of in-store personnel.

However, in order to implement a merchandising system, brands and retailers need to understand the space in which they are placing the merchandising system. This requires a retail audit to gather key measurements such as the depth and width of the shelf area to ensure that the merchandising system fits on the available shelving. The brand needs to know this information for every retailer they serve, which can number into the thousands of stores. The retailer must know this information for all of their locations, which can be different given that many retailers have acquired different locations over the years from different competitors and that levels of renovation may differ between locations. Retail shelving can differ in make, model, manufacturer, and dimensions between store locations, and even within a single location.

Gathering this information requires a retail audit. Retail audits require personnel to drive to the various locations, measure and record the information, and report it back to the administrative manager. The process costs a significant amount of money and time, which can be difficult with the above-mentioned reduction in personnel. Out-of-date or otherwise inaccurate information may further limit personnel attempting to install a merchandising system obtained using this inaccurate information. Furthermore, if a retailer replaces outdated or damaged shelving, the corresponding merchandising system may need to be replaced as well, even if the system is still in usable condition, leading to waste of money and material.

Some brands and retailers have attempted to overcome this problem through the use of merchandising systems capable of size adjustment. However, adjustably-sized merchandising systems may lack the ability to adjust size in multiple dimensions and can be complex, with convoluted size adjustment means and specialized tools that add time, difficulty, and cost to installation and subsequent product stocking. Reduction in personnel results in fewer brand and retail staff available for installation of merchandising systems. Specialized tools required for installation and size adjustment can create a situation where lack of a required tool can limit the ability to install, size, and/or re-size a merchandising system.

Accordingly, there is a need in the art for a merchandising system that adjusts for depth and width to create a universal system, eliminating the need for a retail audit or special adjustment procedures or tools.

BRIEF SUMMARY

The present invention is merchandising tray system. Within the system, a rear tray base is slidably connected to a fore tray base. A merchandise pusher is slidable within a fore pusher track in the fore tray base, the merchandise pusher also being slidable within a rear pusher track in the rear tray base. A right fore sidewall is removably mounted to the fore tray base, and a left fore sidewall removably mounted to the fore tray base. A right rear sidewall is slidably extendable from the right fore sidewall, and a left rear sidewall slidably extendable from the left fore sidewall.

BRIEF DESCRIPTION OF THE DRAWINGS

FIGS. 8*a*, 8*b*, 8*c*, and 8*d* illustrate top, perspective, front, and right-side views, respectively, of an exemplary rear tray base of the exemplary embodiment of the expandable merchandising system.

Figures 1A, 1B:
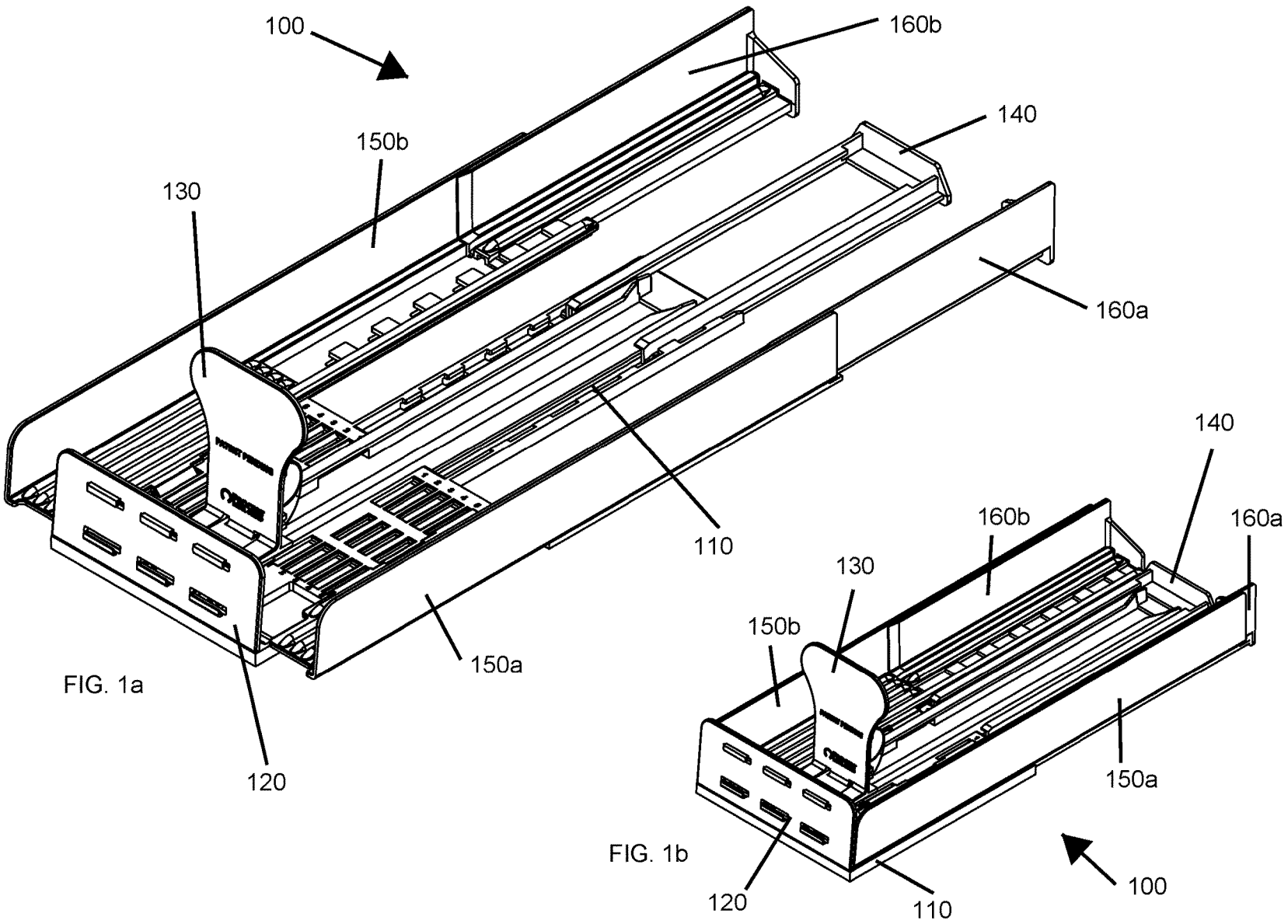
FIGS. 1*a* and 1*b*, illustrate expanded and compacted perspective views, respectively, of an exemplary embodiment of an expandable merchandising system.
Figure 1D:
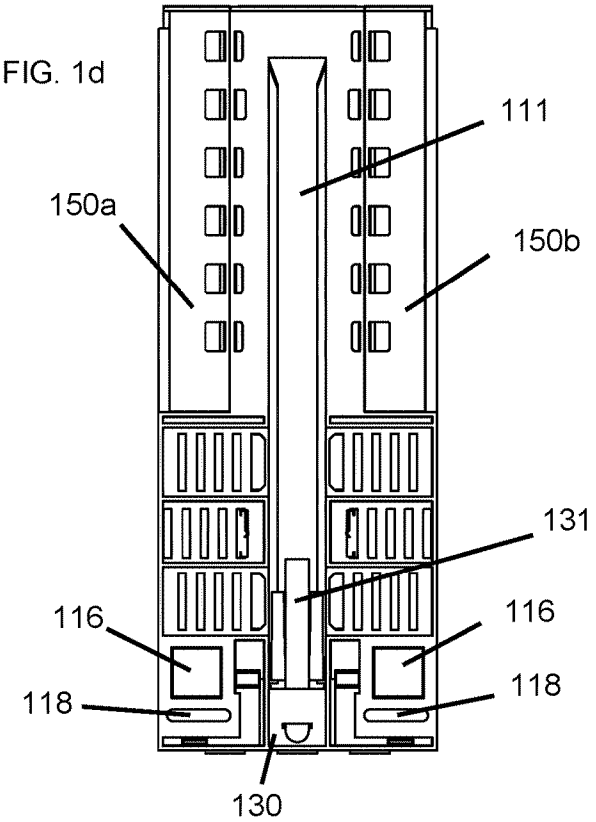
FIGS. 1*c*, 1*d*, 1*e*, and 1*f* illustrate top, bottom, front, and right-side views, respectively, of the exemplary embodiment of the expandable merchandising system.
Figure 1F:
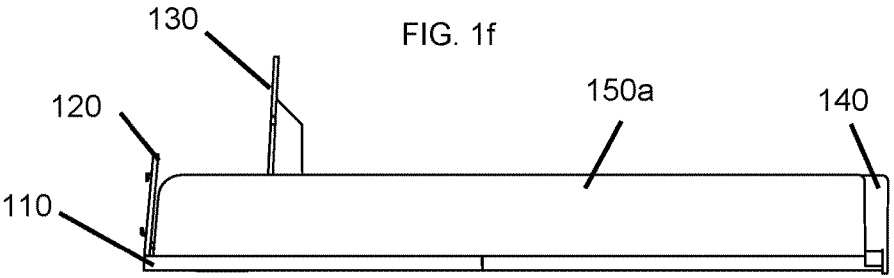
Figure 1C:
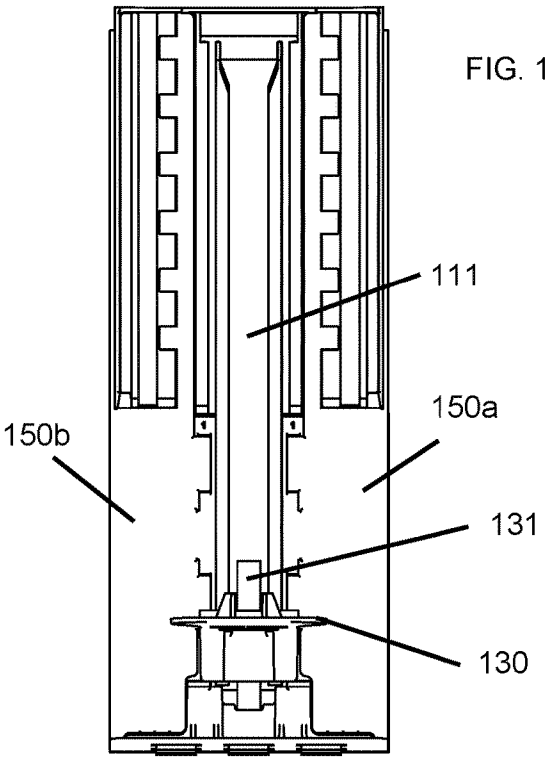
Figure 1E:
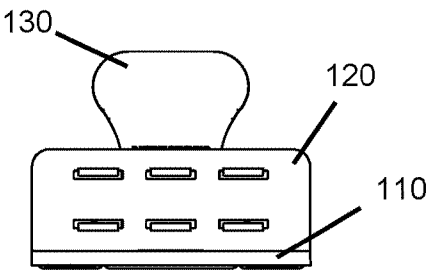
Figure 2B:
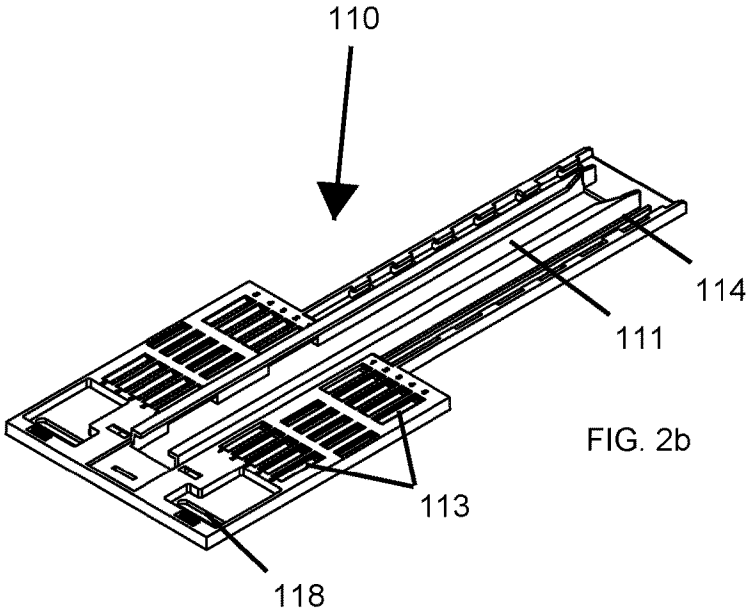
FIGS. 2*a*, 2*b*, 2*c*, and 2*d* illustrate top, perspective, front, and right-side views, respectively, of an exemplary fore tray base of the exemplary embodiment of the expandable merchandising system.
Figure 2D:
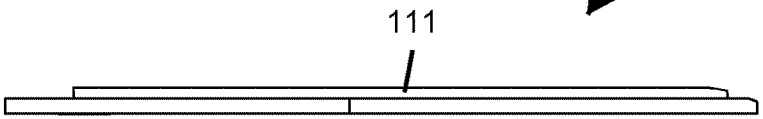
Figure 2A:
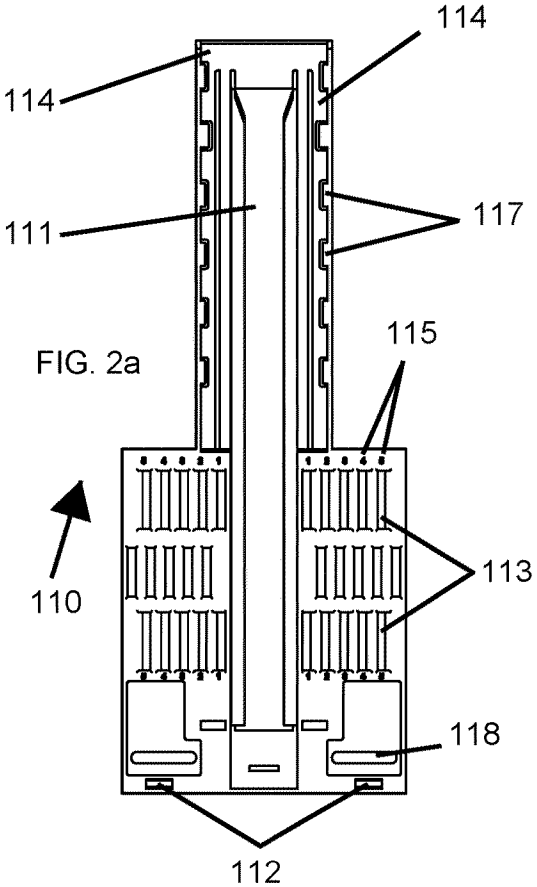
Figure 2C:
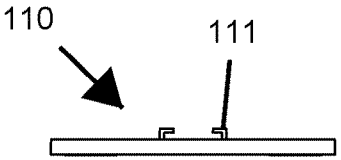
Figure 3B:
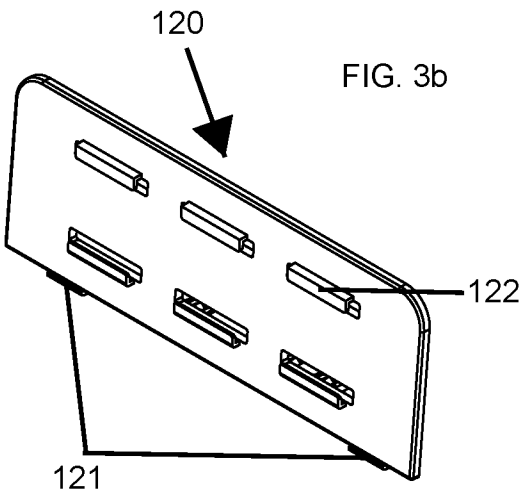
FIGS. 3*a*, 3*b*, 3*c*, and 3*d* illustrate top, perspective, front, and right-side views, respectively, of an exemplary front wall stop of the exemplary embodiment of the expandable merchandising system.
Figure 3D:
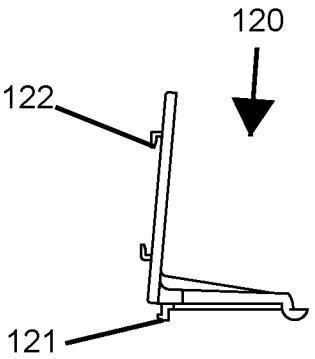
Figure 3A:
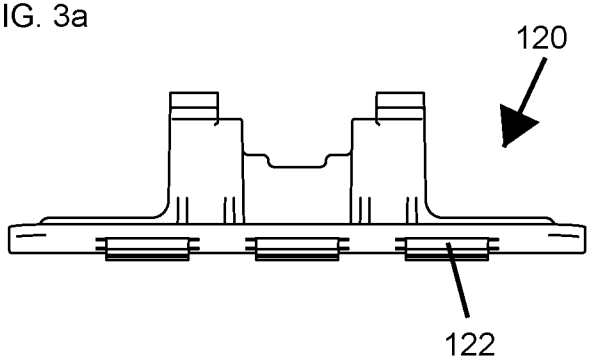
Figure 3C:
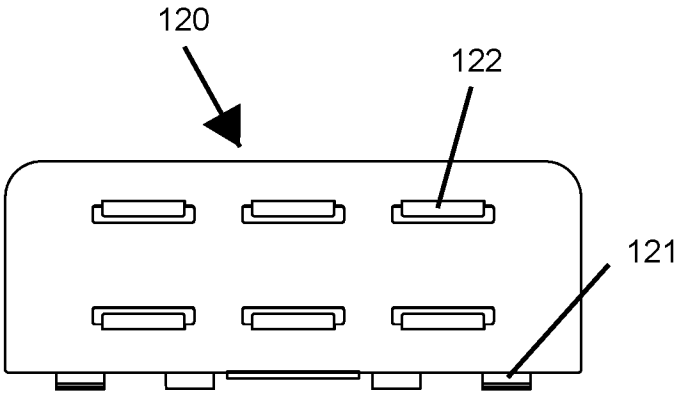
Figure 4B:
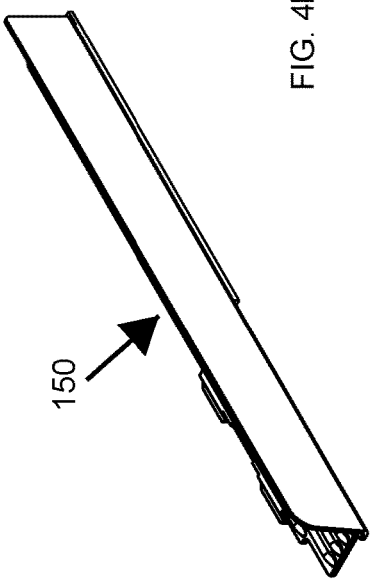
FIGS. 4*a*, 4*b*, 4*c*, and 4*d* illustrate top, perspective, front, and right-side views, respectively, of an exemplary right fore sidewall of the exemplary embodiment of the expandable merchandising system.
Figure 4D:
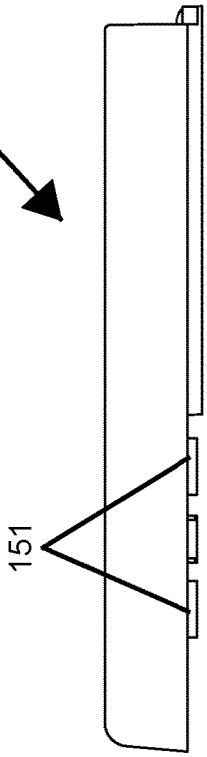
Figure 4A:
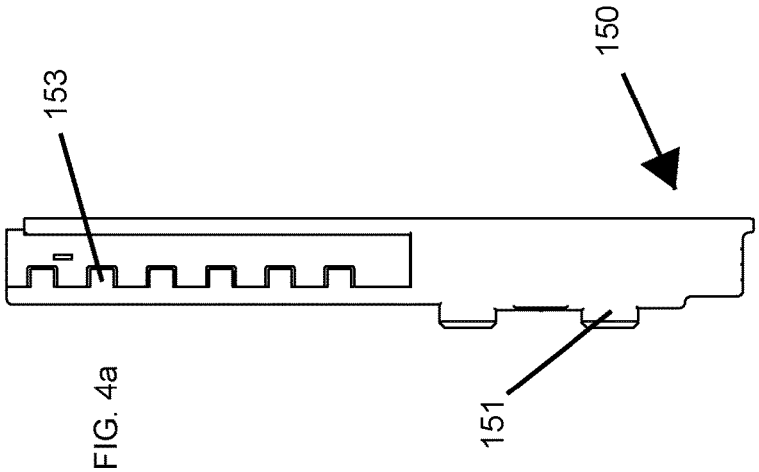
Figure 4C:
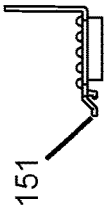
Figure 5A:
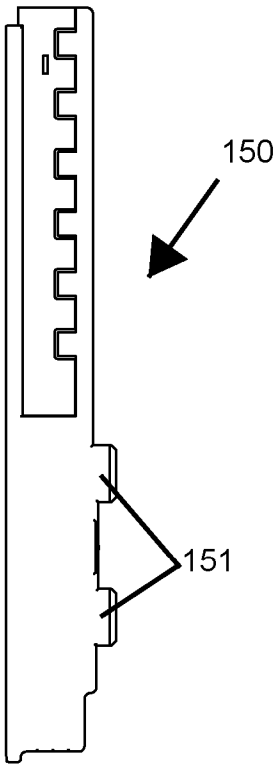
FIGS. 5*a*, 5*b*, 5*c*, and 5*d* illustrate top, perspective, front, and right-side views, respectively, of an exemplary left fore sidewall of the exemplary embodiment of the expandable merchandising system.
Figure 5B:
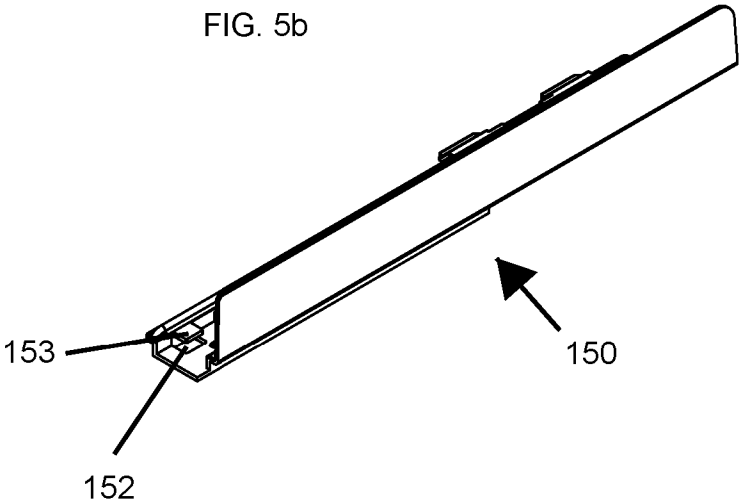
Figure 5C:
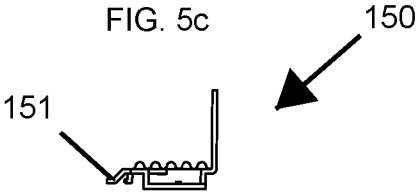
Figure 5D:
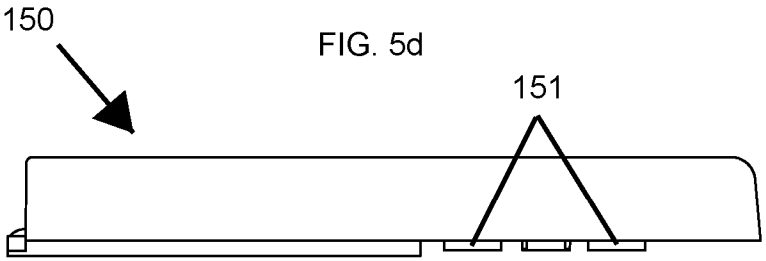
Figure 6A:
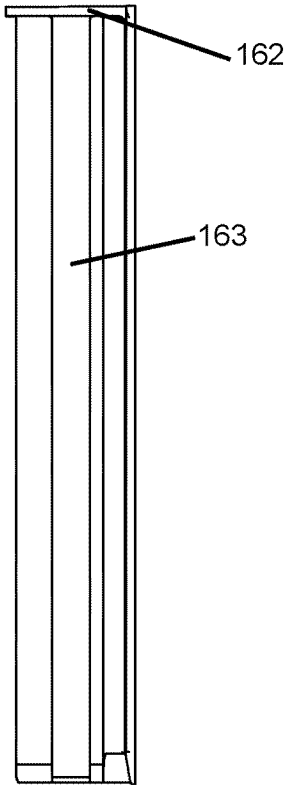
FIGS. 6*a*, 6*b*, 6*c*, and 6*d* illustrate top, perspective, front, and right-side views, respectively, of an exemplary right rear sidewall of the exemplary embodiment of the expandable merchandising system.
Figure 6B:
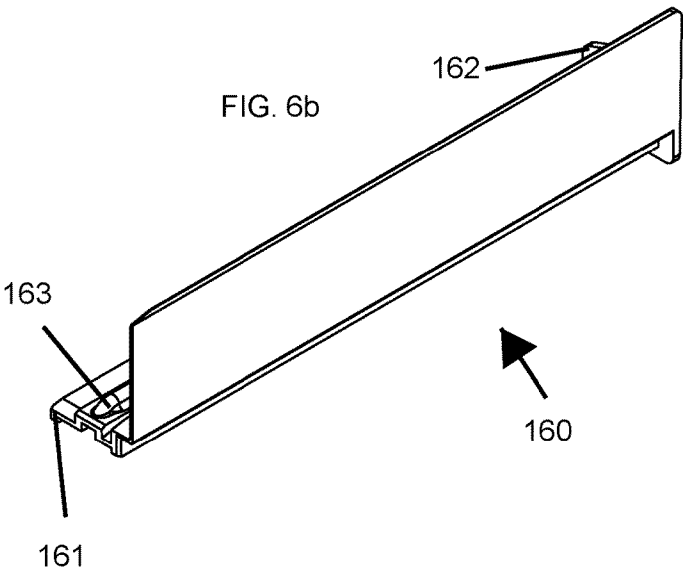
Figure 6C:
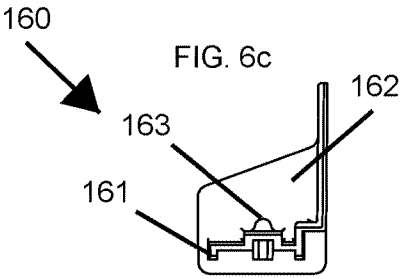
Figure 6D:
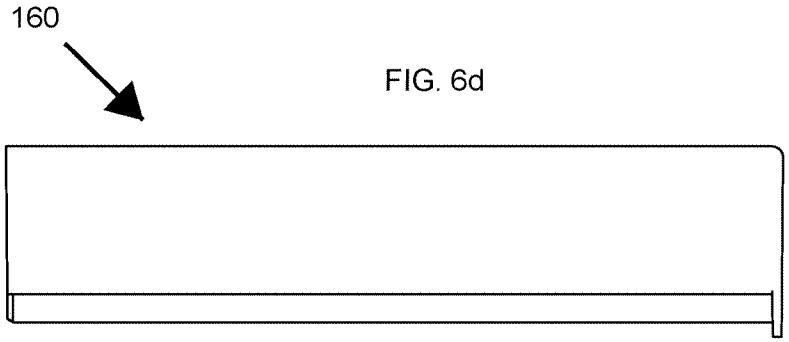
Figure 7B:
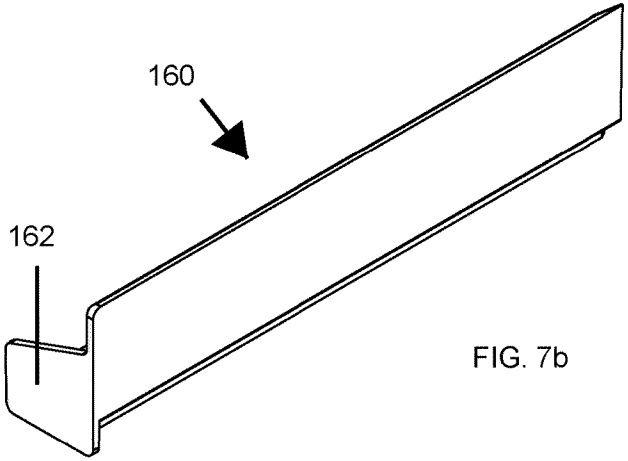
FIGS. 7*a*, 7*b*, 7*c*, and 7*d* illustrate top, perspective, front, and right-side views, respectively, of an exemplary left rear sidewall of the exemplary embodiment of the expandable merchandising system.
Figure 7D:
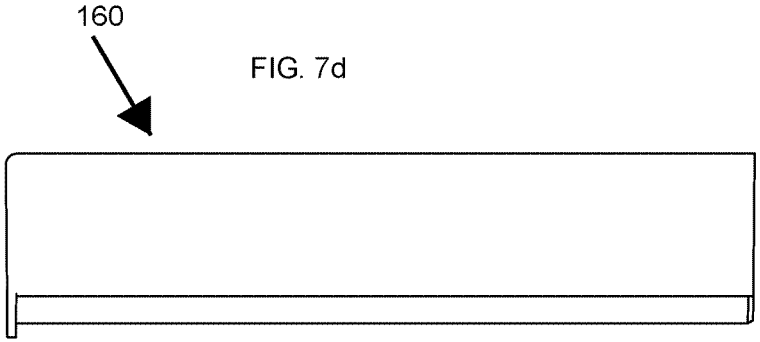
Figure 7A:
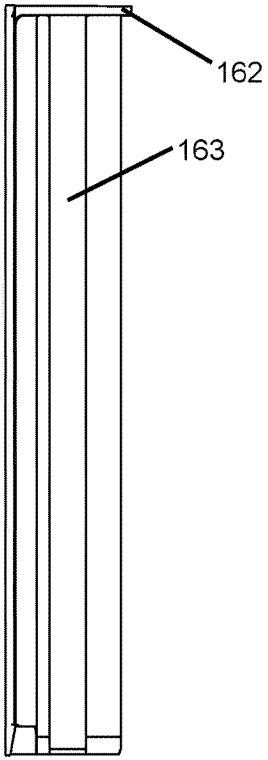
Figure 7C:
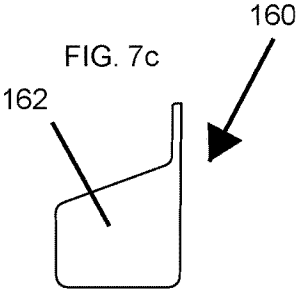
Figure 9B:
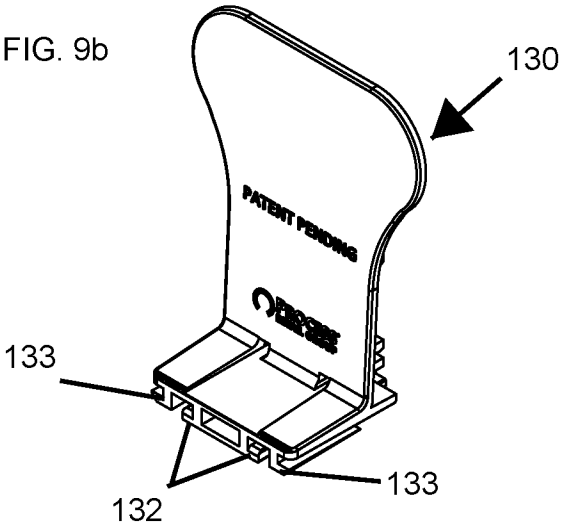
FIGS. 9*a*, 9*b*, 9*c*, and 9*d* illustrate top, perspective, front, and right-side views, respectively, of an exemplary merchandise pusher of the exemplary embodiment of the expandable merchandising system.
Figure 9D:
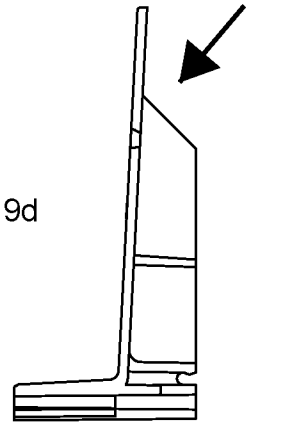
Figure 9A:
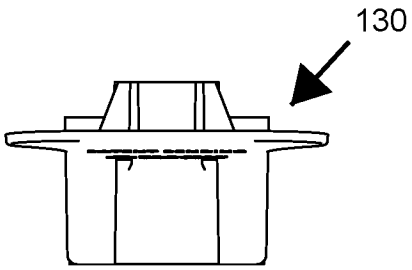
Figure 9C:
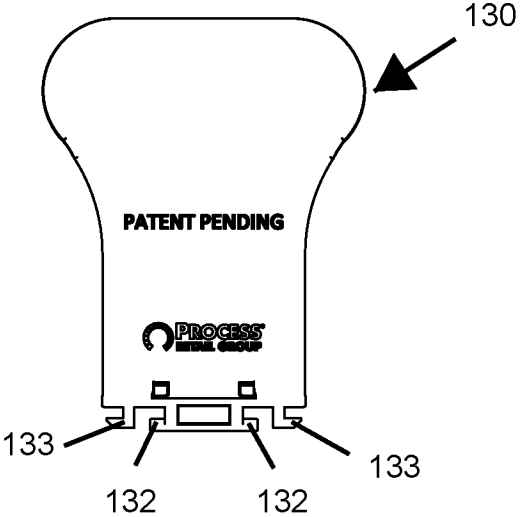

It should be understood that for clarity, not every element is labeled in every figure. Lack of labeling should not be interpreted as lack of disclosure.

DETAILED DESCRIPTION OF THE INVENTION

In the present description, certain terms have been used for brevity, clearness and understanding. No unnecessary limitations are to be applied therefrom beyond the requirement of the prior art because such terms are used for descriptive purposes only and are intended to be broadly construed. The different systems and methods described herein may be used alone or in combination with other systems and methods. Various equivalents, alternatives and modifications are possible within the scope of the appended claims. Each limitation in the appended claims is intended to invoke interpretation under 35 U.S.C. § 112, sixth paragraph, only if the terms "means for" or "step for" are explicitly recited in the respective limitation.

The expandable merchandising system 100 includes a fore tray base 110 supporting a fixed front wall stop 120 and a slidable merchandise pusher 130. In use, merchandise (not shown) may be biased forward by the merchandise pusher 130 until stopped against the front wall stop 120. A rear tray base 140 may be slidably mounted to the fore tray base 110. In use, the rear tray base 140 may slidably extend from and retract into the fore tray base 110 to alter the longitudinal footprint of the expandable merchandising system 100.

Right and left fore sidewalls 150*a* and 150*b* can be removably and adjustably mounted to either side of the fore tray base 110. In use, merchandise may be enclosed between the right and left fore sidewalls 150*a* and 150*b*. Right and left rear sidewalls 160*a* and 160*b* may be slidably mounted to the right and left fore sidewalls 150*a* and 150*b*, respectively. In use, the right and left rear sidewalls 160*a* and 160*b* may slidably extend from and retract into the right and left fore sidewalls 150*a* and 150*b*, respectively, to alter the longitudinal footprint of the expandable merchandising system 100 in a manner akin to the rear tray base 140. In certain embodiments, the lengths of the right and left rear sidewalls 160*a* and 160*b* in full extension are identical to the length of the rear tray base 140 in full extension.

Figure 10B:
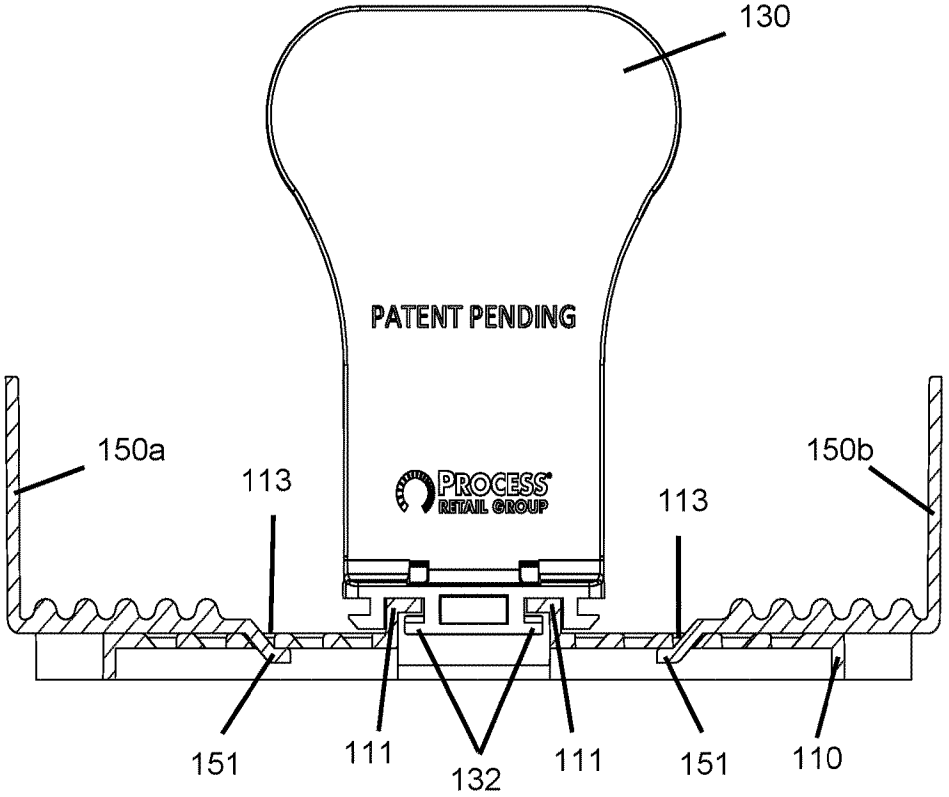
FIGS. 10*a* and 10*b* illustrate top and cross-sectional views, respectively, of the exemplary embodiment of the expandable merchandising system when the merchandise pusher is located towards the front of the expandable merchandising system in the fore base tray.
Figure 10A:
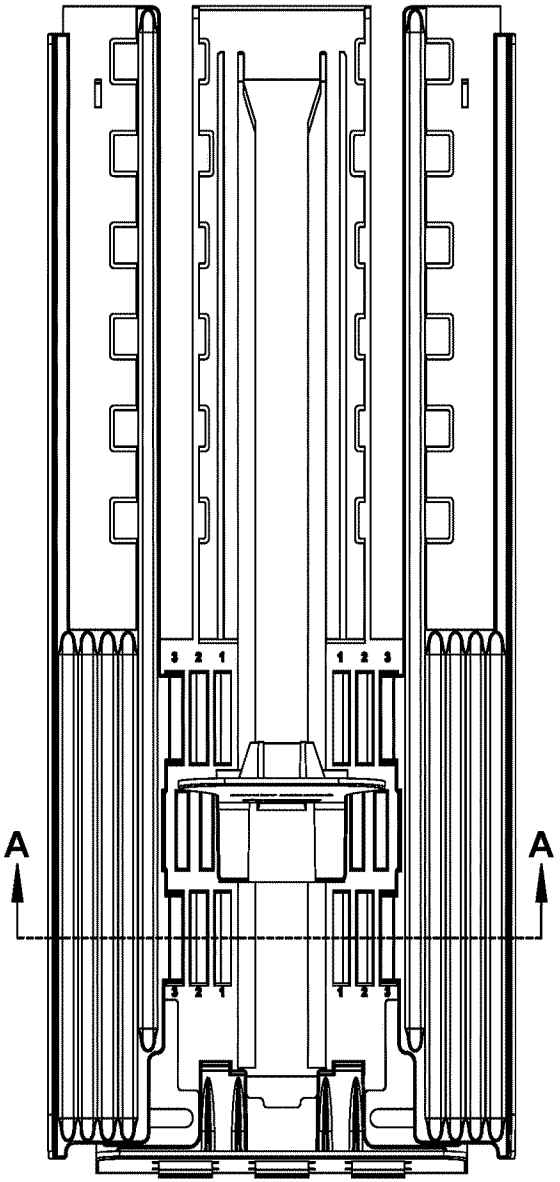

The fore tray base 110 includes a fore pusher track 111 extending longitudinally along the fore tray base 110 from the front wall stop 120. The fore pusher track 111 guides the sliding movement of the merchandise pusher 130, as can be seen in FIG. 10*b*. The merchandise pusher 130 may be biased or moved in a forward direction along the fore pusher track 111 by any movement or biasing mechanism known in the art. In the exemplary embodiment, the motive mechanism is at least one pusher spring 131 interconnecting the fore tray base 110 and the rear of the merchandise pusher 130. The merchandise pusher 130 includes at least one inner track slider 132 which guides the movement of the merchandise pusher 130 along the fore pusher track 111. The configuration of the inner track slider 132 also include some measure of interlocking with the fore pusher track 111 along axes orthogonal to the axis of sliding motion to prevent the merchandise pusher 130 from becoming dislodged from the fore tray base 110.

The fore tray base 110 also includes at least one front wall connection aperture 112 to allow removable attachment of the front wall stop 120. The front wall stop 120 includes at least one wall connection tab 121, which is received by the front wall connection aperture 112. The front wall stop 120 may also include at least one media holder 122 for receiving removable merchandise identification media.

The fore tray base 110 also includes at least one rear expansion channel 114 extending longitudinally along the fore tray base 110 from the front wall stop 120. The rear expansion channel 114 guides the sliding movement of the rear tray base 140 as it extends from and retracts into the fore tray base 110. The rear tray base 140 includes at least one rear expansion slider 143 which guides the movement of the rear tray base 140 along the rear expansion channel 114. The configuration of the rear expansion slider 143 also include some measure of interlocking with the rear expansion channel 114 along axes orthogonal to the axis of sliding motion to prevent the rear tray base 140 from becoming dislodged from the fore tray base 110. The rear tray base 140 may also include at least one base locking tab 144 on the rear expansion slider 143. The base locking tab 144 is rounded or ramped in at least one direction to interact with base channel locking tabs 117 in or on the rear expansion channel 114 and allow discrete intervals of expansion of the merchandising system 100. This also maintains the rear tray base 140 in an expanded position.

As shelves may have varying depths, extension and retraction of the rear tray base 140 allows adjustment of the position of the merchandising system 100. By way of non-limiting example, because the rear tray base 140 is slidably mounted to the fore tray base 110, the rear tray base 140 can extend out of the fore tray base 110 for deeper shelves and freely retract back into the fore tray base 110 for shorter shelves or shelves with depth-restricting structure. Hence, adjustment may keep the back tray stop 142 of the merchandising system 100 flush with or a given distance from the back of the shelf regardless of the depth of the shelf. This allows the merchandising system 100 to adjustably accommodate any depth of shelving even if it is to be securely anchored to the shelf. The sliding rear tray base 140 also allows the retailer or user to adjust the fit of the merchandising system 100 without needing tools.

Figures 11A, 11B:
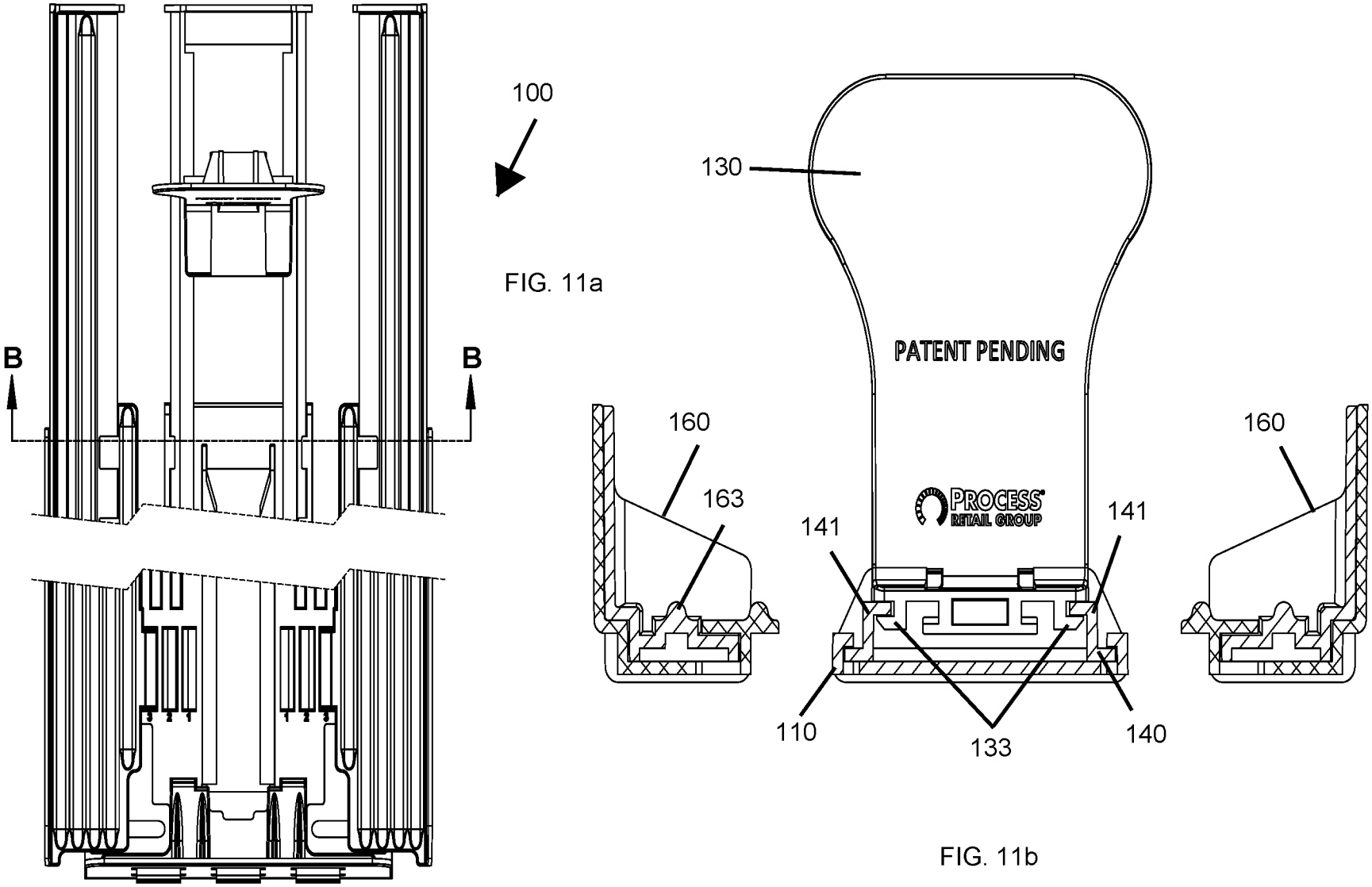
FIGS. 11*a* and 11*b* illustrate top and cross-sectional views, respectively, of the exemplary embodiment of the expandable merchandising system when the merchandise pusher is located towards the back of the expandable merchandising system in the rear base tray.

The rear tray base 140 includes at least one rear pusher track 141 extending longitudinally along the rear tray base 140 and stopping at a back tray stop 142 located at the far back of the merchandising system 100. The rear pusher track 141 guides the sliding movement of the merchandise pusher 130, as can be seen in FIG. 11*b*. The rear pusher track 141 is continuous with the fore pusher track 111, beginning at the end of the fore pusher track 111 and forming a continuous path of motion for the merchandise pusher 130. The merchandise pusher 130 includes at least one outer track slider 133 which guides the movement of the merchandise pusher along the rear pusher track 141. The configuration of the outer track slider 133 also include some measure of interlocking with the rear pusher track 141 along axes orthogonal to the axis of sliding motion to prevent the merchandise pusher 130 from becoming dislodged from the rear tray base 140. While the inner track slider 132 and the outer track slider 133 are described as interacting with the fore pusher track 111 and the rear pusher track 141, respectively, an embodiment which reverses such interaction is also contemplated.

The right and left fore sidewalls 150*a* and 150*b* can be removably and adjustably mounted to either side of the fore tray base 110 to accommodate a broad range of merchandising widths, as can be seen in FIG. 10*b*. The right fore sidewall 150*a* is an L-shaped sidewall. At least one lateral expansion tab 151 extends at an angle from the lower leg of the right fore sidewall 150*a*. The lateral expansion tab 151 interlocks with at least one lateral expansion aperture 113 on an upper surface of the fore tray base 110. In embodiments with more than one lateral expansion aperture 113 spaced laterally on the fore tray base 110, the right fore sidewall 150*a* may be placed in multiple lateral positions to accommodate different merchandising widths. In such an embodiment, lateral indicia 115 may be added on the fore tray base 110 to indicate particular widths resulting from use of a particular lateral expansion aperture 115. Selecting a particular lateral expansion aperture 115 will therefore result in a specific spacing of the right fore sidewall 150*a* or the left fore sidewall 150*b* from a center of the fore tray base 110.

The right fore sidewall 150*a* also includes a longitudinal expansion channel 152 extending longitudinally along the right fore sidewall 150*a* from a point behind the front wall stop 120. The longitudinal expansion channel 152 guides the sliding movement of the right rear sidewall 160*a* as it extends from and retracts into the right fore sidewall 150*a*, as can be seen in FIG. 11*b*. The right rear sidewall 160*a* includes at least one longitudinal expansion slider 161 which guides the movement of the right rear sidewall 160*a* along the longitudinal expansion channel 152. The configuration of the longitudinal expansion slider 161 also include some measure of interlocking with the longitudinal expansion channel 152 along axes orthogonal to the axis of sliding motion to prevent the right rear sidewall 160*a* from becoming dislodged from the right fore sidewall 150*a*.

The right rear sidewall 160*a* may also include at least one sidewall elevating rib 163 on the rear expansion slider 143. The sidewall elevating rib 163 is rounded or ramped in at least one direction to interact with products in the merchandising system 100 as they are pushed forward and backward along the right rear sidewall 160*a*. The sidewall elevating rib 163 helps to maintain the bottommost edge of the product at a constant height, preventing it from being damaged in the changeover from the right rear sidewall 160*a* to the right fore sidewall 150*a*.

The right rear sidewall 160*a* also includes a back sidewall stop 162 located at the far back of the merchandising system 100. The back tray stop 142 and the back sidewall stop 162 help to prevent merchandise from falling out of the rear of the merchandising system.

The left fore sidewall 150*b* and the left rear sidewall 160*b* are identical in structure and function to the right fore sidewall 150*a* and the right rear sidewall 160*a*, respectively, save for a necessarily mirrored configuration.

At least one foam pad 116 may be attached to a bottom surface of the fore tray base 110 to increase friction between the shelf and the fore tray base 110, and to provide some cushioning of the merchandising system 100. Anchors such as, but not limited, screws and pins may extend through at least one anchor aperture 118 in the fore base tray 110 and into the shelf below to anchor the merchandising system 100 in place. Portions of the merchandise system 100 such as, but not limited to, the fore tray base 110 and the fore sidewalls 150 may have ridged or corrugated surfaces for increased strength. Portions of the merchandise system 100 may be manufactured in an injection molding process. Portions of the merchandise system 100 may be manufactured from clear and/or opaque polymers such as, but not limited to, polycarbonate, polyoxymethylene, and/or acrylonitrile butadiene styrene. The pusher spring 131 may be a coil spring manufactured from spring steel.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims.

The invention claimed is:

1. A merchandising system, the merchandising system comprising:

a rear tray base slidably connected to a fore tray base, a plurality of lateral expansion apertures extending through an upper surface of the fore tray base;

a merchandise pusher slidable within a fore pusher track in the fore tray base, the merchandise pusher also being slidable within a rear pusher track in the rear tray base;

a right fore sidewall removably mounted to the fore tray base, and a left fore sidewall removably mounted to the fore tray base;

at least one right lateral expansion tab extending from the right fore sidewall, and at least one left lateral expansion tab extending from the left fore sidewall, wherein each of the at least one right lateral expansion tab and the at least one left lateral expansion tab removably interlocks with at least one of the plurality of lateral expansion apertures by extending downwardly at a non-zero angle through the at least one of the plurality of lateral expansion apertures; and a right rear sidewall slidably extendable from the right fore sidewall, and a left rear sidewall slidably extendable from the left fore sidewall.

2. The system of claim 1, wherein the at least one right lateral expansion tab extends at an angle from a lower leg of the right fore sidewall, and wherein the at least one left lateral expansion tab extends at an angle from a lower leg of the left fore sidewall.

3. The system of claim 1, wherein the plurality of lateral expansion apertures comprises a plurality of lateral expansion apertures on an upper right surface of the fore tray base and a plurality of lateral expansion apertures on an upper left surface of the fore tray base.

4. The system of claim 1, further comprising a plurality of lateral indicia on the fore tray base, wherein each of the lateral indicia indicates a specific spacing of the right fore sidewall or the left fore sidewall from a center of the fore tray base resulting from use of one of the plurality of lateral expansion apertures.

5. The system of claim 1, wherein a length of the right rear sidewall and a length of the left rear sidewall are identical to a length of the rear tray base.

6. The system of claim 1, wherein the fore pusher track extends longitudinally along the fore tray base and extends from a front wall stop to the rear pusher track such that the rear pusher track is continuous with the fore pusher track, forming a continuous path of motion for the merchandise pusher.

7. The system of claim 6, wherein the rear pusher track extends longitudinally along the rear tray base and extends from the fore pusher track to a back tray stop.

8. The system of claim 1, wherein the fore pusher track slidably connects to at least one inner track slider or at least one outer track slider of the merchandise pusher to guide the movement of the merchandise pusher along the fore pusher track.

9. The system of claim 8, wherein the fore pusher track interlocks with the at least one inner track slider or the at least one outer track slider along axes orthogonal to the axis of sliding motion to prevent the merchandise pusher from becoming dislodged from the fore tray base.

10. The system of claim 8, wherein the rear pusher track slidably connects to the at least one inner track slider or the at least one outer track slider of the merchandise pusher to guide the movement of the merchandise pusher along the rear pusher track.

11. The system of claim 10, wherein the rear pusher track interlocks with the at least one inner track slider or the at least one outer track slider along axes orthogonal to the axis of sliding motion to prevent the merchandise pusher from becoming dislodged from the rear tray base.

12. The system of claim 1, wherein the fore tray base further comprises at least one rear expansion channel extending longitudinally along the fore tray base to guide sliding extension of the rear tray base.

13. The system of claim 12, wherein the rear tray base comprises at least one rear expansion slider slidably extending through the rear expansion channel.

14. The system of claim 13, wherein the rear expansion channel interlocks with the at least one rear expansion slider along axes orthogonal to the axis of sliding motion to prevent the rear tray base from becoming dislodged from the fore tray base.

15. The system of claim 13, wherein the rear tray base comprises at least one base locking tab on the at least one rear expansion slider.

16. The system of claim 13, wherein the at least one base locking tab is rounded or ramped in at least one direction to interact with a plurality of base channel locking tabs located in or on the rear expansion channel.

17. The system of claim 1, wherein each of the right fore sidewall and the left fore sidewall comprises a longitudinal expansion channel extending longitudinally along the right fore sidewall or the left fore sidewall to guide the sliding movement of the right rear sidewall or the left rear sidewall, respectively.

18. The system of claim 1, wherein each of the right rear sidewall and the left rear sidewall comprises at least one sidewall elevating rib.

* * * * *